US005094451A

United States Patent [19]

Glamack

[11] Patent Number: 5,094,451

[45] Date of Patent: Mar. 10, 1992

[54] COMBINATION GOLF SCORE RECORDING FORM AND YARDAGE MAP GUIDE

[76] Inventor: Mark G. Glamack, 1120 Oneonta Dr., Los Angeles, Calif. 90065

[21] Appl. No.: 611,533

[22] Filed: Nov. 13, 1990

[51] Int. Cl.[5] ..... A63B 69/36; G09B 19/22

[52] U.S. Cl. ..... 273/32 H; 283/49

[58] Field of Search ..... 273/32 H, 176 L, 32 R; 283/34, 49, 50; 434/252

[56] References Cited

U.S. PATENT DOCUMENTS

| | | | |
|---|---|---|---|
| 4,068,972 | 1/1978 | Stuart | 283/49 |
| 4,331,425 | 5/1982 | Davis | 273/32 H |
| 4,666,157 | 5/1987 | Bodine et al. | 273/32 H |
| 4,783,071 | 11/1988 | Tattershall | 273/32 H |

*Primary Examiner*—George J. Marlo

*Attorney, Agent, or Firm*—Allan M. Shapiro

[57] ABSTRACT

The guide includes first, second and third sheets, each having first and second principal sides, foldably joined at one edge to each other in series such that the first and second sides are aligned on opposite sides of the joined sheets. The first and third sheets are foldable over either side of the second sheet. The second side of the third sheet includes a first portion of a yardage map of the holes of a golf course printed thereon, while the first side of the third sheet includes the second or remaining portion of the yardage map printed thereon. The first side of the first sheet includes a first portion of a golf score recording form corresponding to the first portion of the yardage map printed thereon and the first side of the second sheet has the second or remaining portion of the golf score recording form corresponding to the second portion of the yardage map printed thereon.

6 Claims, 3 Drawing Sheets

FIG. 3
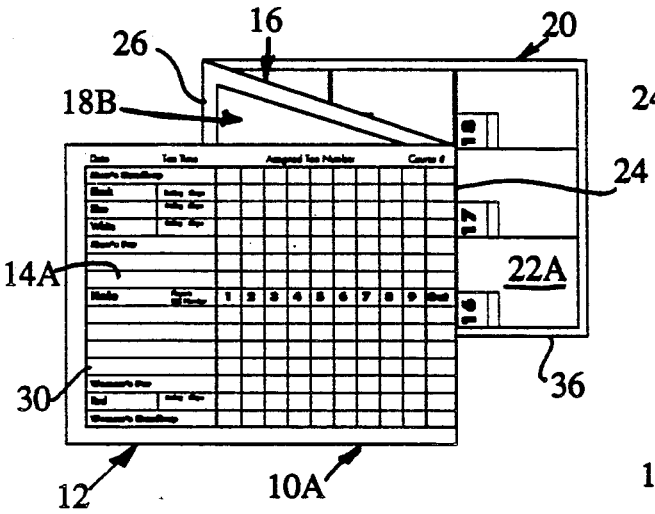
FIG. 4
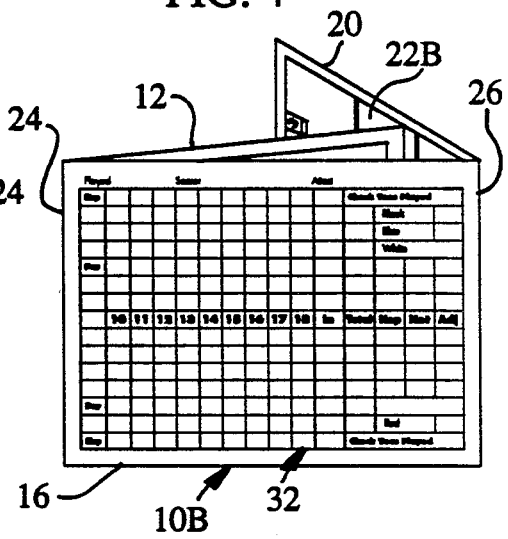
FIG. 5
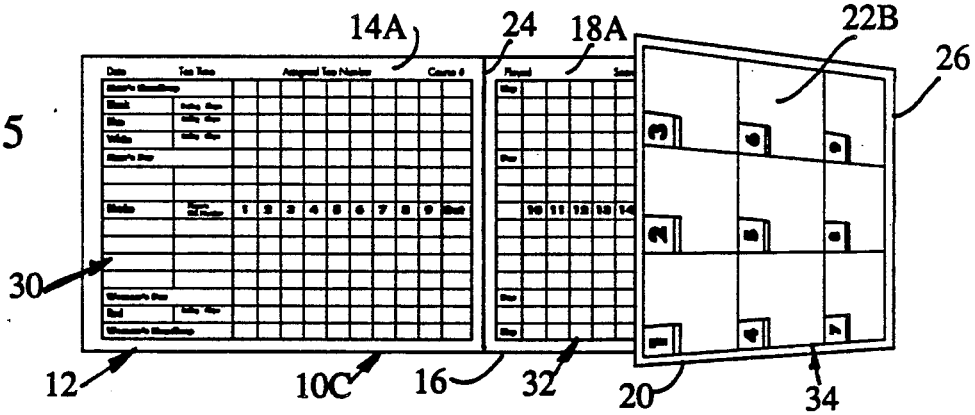
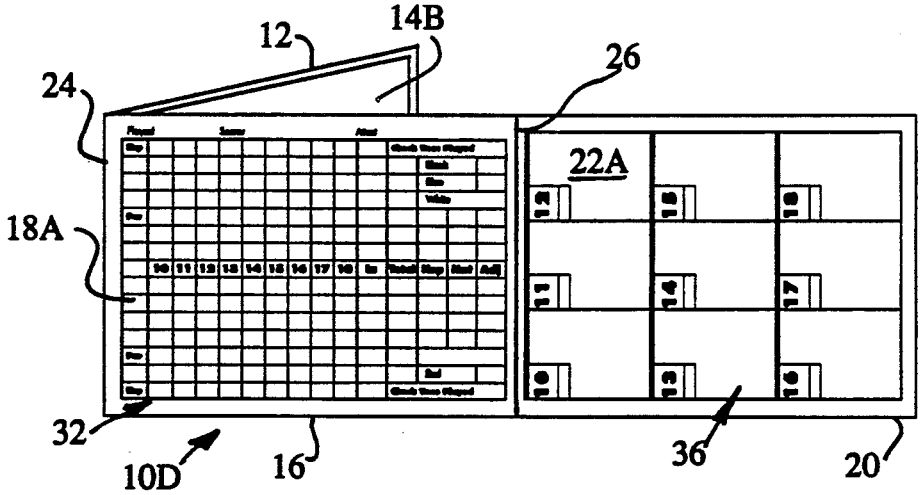
FIG. 7

COMBINATION GOLF SCORE RECORDING FORM AND YARDAGE MAP GUIDE

BACKGROUND OF THE INVENTION

1. Field of the Invention

The invention relates to the field of golf course scorecards and yardage indicators and the like and, in particular, to a combination golf score recording form and yardage map guide.

2. Description of Related Art

Most golf courses follow the basic 18-hole format, except a few smaller courses that have only 9-holes. Each golf course is unique, taking advantage of the local terrain, lakes and trees. However, the course is arranged to have a combination of 3, 4 and 5 par holes, with a total par for the course of generally equal to 72 strokes. The length of the holes from tee to the middle of the putting green very from around 160 to 200 yards for a par 3-hole, 350 to 450 yards for a par 4-hole and over 500 for a par 5-hole. Additionally, the length of holes is set at a shorter distance for woman and at a longer distance for championship play. This is accomplished by adjusting the tee-off locations for each hole. Thus, any scorecard, providing the length and par for each hole, is unique to each golf course.

Also, because the distance a golfer can drive the ball with a particular club varies greatly with the individual, it is important that the golfer know, at all times, his or her distance from the green. It becomes especially critical when making approach shots to the green. This information is traditionally provided by a yardage map that indicates the total yardage from specified locations along the fairways to the center of the green, the position of pin on the green and strategically placed obstacles. Some also provide a verbal description of the hole as well as information on how to "play" it. The yardage map, therefore, contains invaluable information for the golfer.

Traditionally, the scorecard and yardage map have been separate documents; in some cases, they have been combined into a single booklet. Yet, in both instances, little or no thought has been given to the golfer's actual needs. The golfer requires that the individual cards or booklet be within his or her reach at all times. Golfers refer to the cars or booklet at the beginning of each hole, and again at the end thereof, to write down the score. The yardage map is referred to on the fairways to decide which club to use.

For those golfers who walk and carry their golf bag or use a pull cart, the booklet or cards are kept in the pockets of their attire or in their golf bag or both. Although rarely seen, some golfers use flat-surface attachments for the handle of their pull cart and clamp the cards or booklet to its surface. For those golfers who use electric-powered carts, the card or booklet can be secured to a clipboard that is normally attached to the steering wheel.

An example of a booklet providing both a scorecard and yardage map can be found in U.S. Pat. No. 4,783,071 "Golf Course Pin Distance Determination Device" by H. D. Tattershall. A map of the individual hole is provided on each page with a score card for that individual hole. Thus, 18 pages (9 if printing is on both sides of the sheet) are necessary, and the golfer cannot at any one time view his or her complete score. Furthermore, with at least 9 pages, it will be bulky and is not likely to fit into a pocket. What is most likely to happen is that the golfer will "lose" his or her place and spend time looking for the proper page. Another disadvantage is that there are costs involved in printing and assembling a 9-page booklet.

Other examples of a combination score card and yardage map can be found in U.S. Pat. Nos. 4,331,425 "Golf Score Card and Hole Information Guide" by J. W. Davis, Jr. and 4,666,157 "Golf Course Playing Apparatus" by J. A. Bodine et al. Both the Davis, Jr. and Bodine et al. patents allow the viewing of the entire score at any given time; however, they have the remaining disadvantages of the Tattershall design. Of lessor interest are U.S. Pat. Nos. 4,655,451 "Golfer's Aid Apparatus and Method of Use Thereof" by P. A. Townsley and 4,666,156 "Method of Producing a Golfing Aid" by K. K. N. Shot et al., both of which disclose methods of making yardage maps for individual holes.

Thus, it is a primary object of the subject invention to provide a combination golf score recording form and yardage map guide for a golf course.

It is another primary object of the subject invention to provide a combination golf score recording form and yardage map for a golf course that is small and compact.

It is further object of the subject invention to provide a combination golf score recording form and yardage map for a golf course that is easy to use and store.

It is a still further object of the subject invention to provide a combination golf score recording form and yardage map for a golf course that is inexpensive to produce.

SUMMARY OF THE INVENTION

The invention is a combination golf score recording form and yardage map guide. The guide includes first, second and third sheets, each having first and second principal sides. The first, second and third sheets are foldably joined at one edge to each other in series such that the first and second sides are aligned on opposite sides of the joined sheets. The first and third sheets are foldable over either side of the second sheet. The second side of the third sheet includes a first portion of a yardage map of the holes of a golf course printed thereon, while the first side of the third sheet includes the second or remaining portion of the yardage map printed thereon. Thus, for the typical 18-hole golf course, the second side of the third sheet would cover the first 9-holes, while the first side would cover the second 9-holes (typically referred to as the front and back 9). The first side of the first sheet includes a first portion of the golf score recording form corresponding to the first portion of the yardage map of the golf course printed thereon and the first side of the second sheet includes the second or remaining portion of the golf score recording form corresponding to the second portion of the yardage map.

Because the guide is usually only used once, it is preferably made of a single sheet of somewhat stiff but, as previously stated, foldable paper. However, it could be made from another material such as a plastic material. Also, it could be made from three separate sheets mechanically connected. Each of the sheets is preferably the same size, i.e., has the same length and width, so that, when the sheets are folded upon each, the resulting package is three-sheets thick but otherwise the same size as a single sheet. Thus, the guide is compact and convenient.

To use the guide, the golfer first folds the third sheet over onto the second side of the second sheet and, thereafter, folds the first sheet over on to the first side of the second sheet. This will place the first portion of the golf score recording form for the first 9-holes on one side and the first portion of the yardage map on the other side. After the first 9-holes are completed, the guide is opened and the first sheet is folded over onto the second side of the second sheet and the third sheet is folded over the first sheet. This will place the second portion of the golf score recording form on one side of the guide and the second portion of the yardage map on the other. Of course, this procedure could be reversed if one were starting on the "back nine" first.

If compactness is not required, then only the third sheet need be folded over onto the first side of the second sheet. It is readily apparent that, in doing so, only the first portion of the golf score recording form and the first portion of the yardage map will be visible from one side. In this configuration it can be attached to a clipboard mounted on the steering wheel of a golfing cart. The guide can be converted for playing the second 9-holes by opening up the guide and refolding it such that the first sheet is folded over onto the second side of the second sheet. Here, only the second portion of the golf score recording form and the second portion of the yardage map is visible from one side.

The novel features that are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 3 is a perspective view of the guide partially folded to a first configuration for use on the first 9 holes of a golf course.

FIG. 4 is a perspective view of the guide partially folded to a first configuration for use on the second 9 holes of a golf course.

FIG. 5 is a perspective view of the first side of the guide partially folded to a second configuration for use on the first 9-holes of a golf course.

FIG. 7 is a perspective view of the first side of the guide partially folded to a second configuration for use on the second 9-holes of a golf course.

DESCRIPTION OF THE PREFERRED EMBODIMENT

Figure 2:
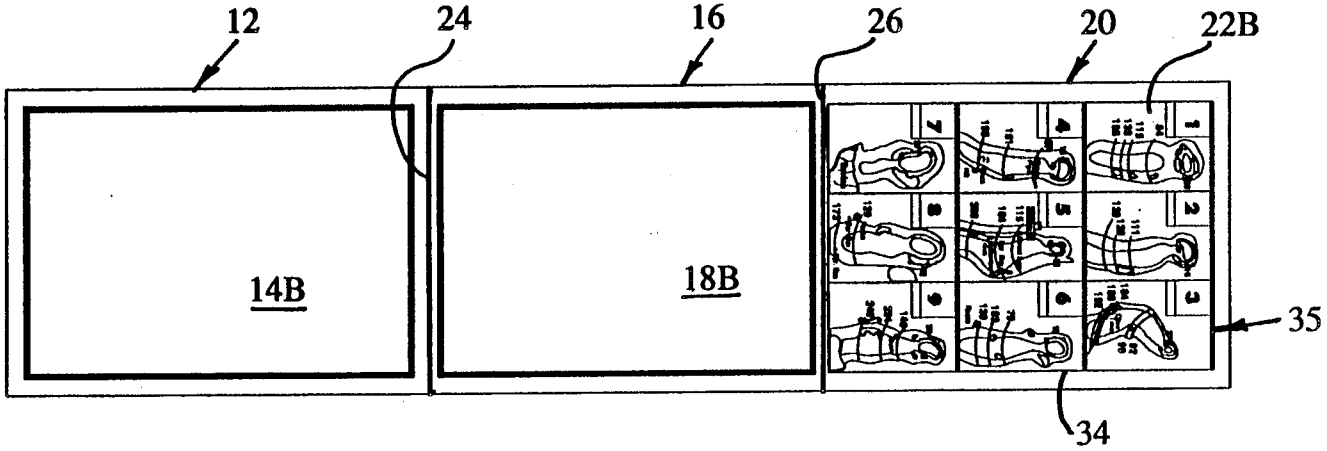
FIG. 2 is a view of the second side of the guide.
Figure 1:
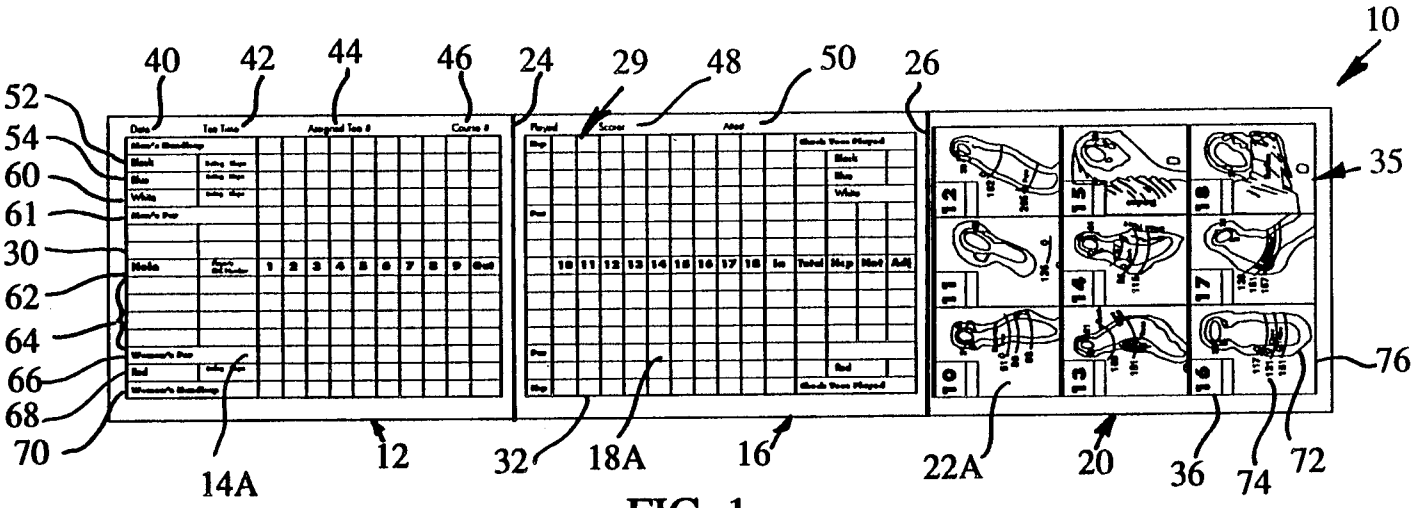
FIG. 1 is a view of a first side of the guide.

Referring to FIGS. 1 and 2, it can be seen that the combination golf score recording form and yardage map guide is generally indicated by numeral 10. The guide 10 includes: a first sheet 12, having first and second sides, 14A and 14B, respectively; a second sheet 16, having first and second sides, 18A and 18B, respectively; and a third sheet 20, having first and second sides, 22A and 22B, respectively. Preferably, the guide 10 is made up of a single piece of paper and the three sheets 12, 16 and 20 are connected in series by one edge to each other along fold lines 24 and 26. If the guide 10 is made of paper, it should be somewhat stiff but still foldable. However, it may be made of other materials such as a flexible plastic and also can consist of three separate sheets joined by mechanical fastening means (not shown).

Printed on sides 14A and 18A of sheets 12 and 16, respectively, is a golf score recording form 29 comprising first and second portions, 30 and 32, respectively, covering the first and second 9-holes of a 18 hole golf course. Printed on the second side 22B of sheet 20 is a first portion 34 covering the first 9-holes of a yardage map 35 of the 18-hole golf course, while printed on the first side 22A of the sheet 20 is a second portion 36 covering the second 9-holes of the yardage map. The second sides 14B and 18B of the first and second sheets 12 and 16, respectively, may have optional printing thereon. This may include such items as the name and logo of the golf course and rules of the particular course.

The portions 30 and 32 of the golf score recording form 29 may take many forms but generally contain similar information. As illustrated, the portions, when combined, contain spaces and lines for the following information:

| | |
|---|---|
| The date | 40 |
| The tee time | 42 |
| Assigned tee number | 44 |
| Course number | 46 |
| Scorer | 48 |
| Witness | 50 |
| Length of each hole for a championship | 52 |
| Length of each hole for men's regular play | 54 |
| Men's handicap | 60 |
| Men's par for each hole | 61 |
| Identification of holes | 62 |
| Players | 64 |
| Length of each hole for women's regular play | 66 |
| Women's par for each hole | 68 |
| Women's handicap | 70 |

The yardage map 35 also may vary as to content. For purposes of illustration only, the depicted yardage map contains a map of each hole indicated by numeral 72, distances of specific landmarks along each hole from the green such as at 74, and information 76 on the par and the distance of the various tees from the green.

Referring to FIG. 3, it can be seen that the guide 10 can be easy folded into the shape, indicated by numeral 10A. This is accomplished by folding sheet 12 against side 18B and sheet 20 against side 18A of the sheet 16. When so folded, the guide 10A is very compact with only the first portion 30 of the golf score recording form 29 on one side and the first portion of the yardage map 34 on the other side being visible. In such a compact shape, the guide 10A can be easily stored on the golfer's attire or clipped to the golfer's bag.

After completion of the first 9-holes, the guide 10A is opened and refolded as shown in FIG. 4. The sheet 12 is folded over onto side 18B and, after that, sheet 20 is folded over and onto sheet 12, forming the guide into the shape indicated by numeral 10B. In this configuration, only the second portion 32 of the golf score recording form 29 is visible from one side and the second portion 36 of the yardage map 35 on the other. At the completion of the round of golf, the guide 10B is opened to its original shape and the total recorded score becomes visible.

Figure 6:
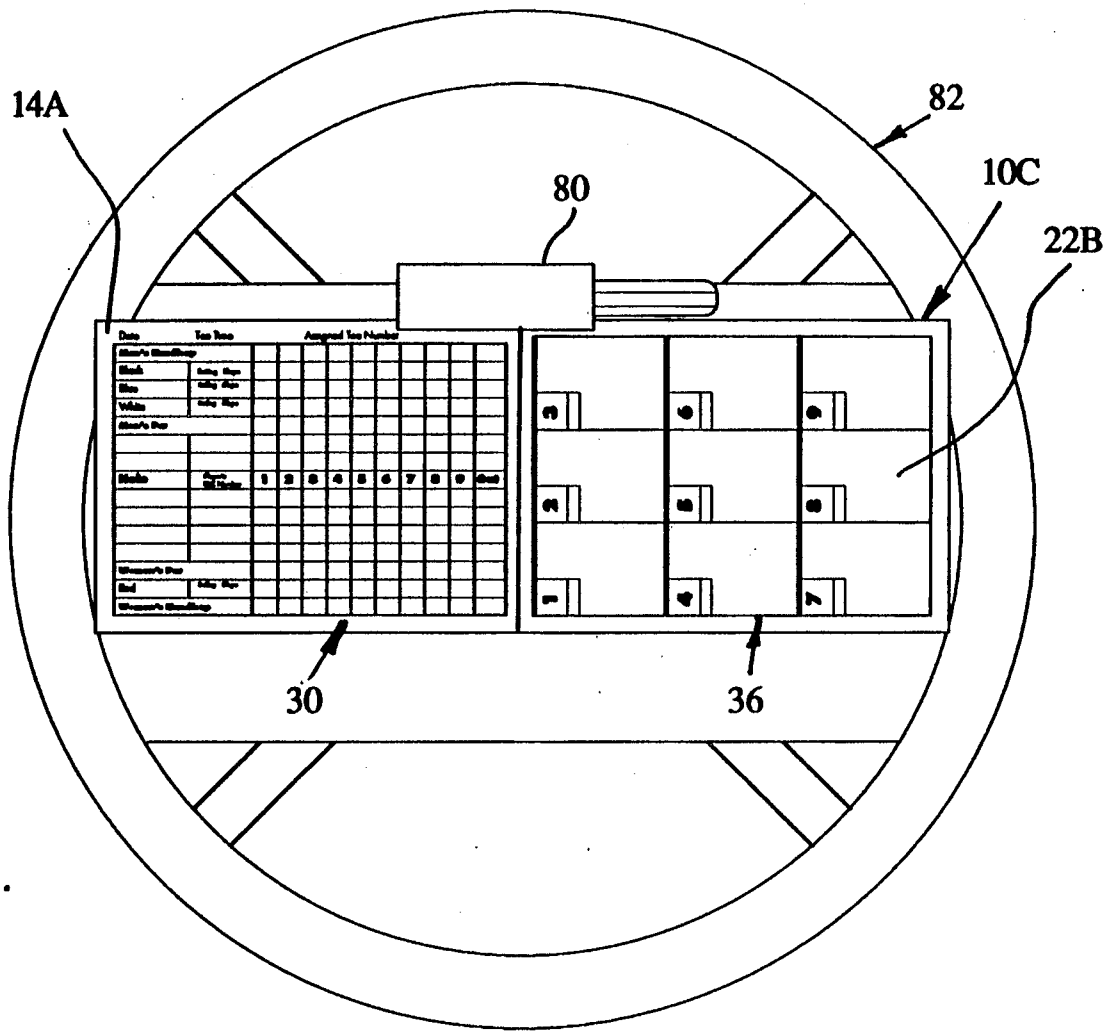
FIG. 6 is a view of the guide shown in FIG. 5 mounted on the steering wheel of a golf cart.

Referring to FIGS. 5 and 6, it can be seen that, if compactness is not required, then only the sheet 20 need be folded over onto side 18A of sheet 16 to form the guide into the shape indicated by numeral 10C (best seen in FIG. 6) It is readily apparent that only the first portion 30 of the golf score recording form 29 and the first portion 34 of the yardage map 35 are visible from one side. In this configuration it can be attached to a clipboard 80 mounted on the steering wheel 82 of a powered golfing cart (not shown) Referring to FIG. 7, it can be seen that the guide 10C can be converted for playing the second 9-holes by opening up the guide and refolding it such that sheet 12 is folded over onto side 18B of the second sheet 16. This forms a guide having the shape indicated by numeral 10D, with only the second portion 32 of the golf score recording form 29 and the second portion 36 of the yardage map 35 visible from one side.

Thus, it is readily seen that the guide is inexpensive to make since it can be made out of one piece of paper, easy to use and is small and compact and, thus, can be placed easily in a pocket of a shirt or sweater.

Although the printed information on sides 14A and 18A has been illustrated in horizontal alignment, it should be clear that such alignment is not essential since, in use, only one side 14A or the other 18A will be displayed at any one time during normal usage of the guide. Accordingly, the printed information can be printed in other formats, such as vertical, by orienting the information 90 degrees from that shown.

While the invention has been described with reference to a particular embodiment, it should be understood that the embodiment is merely illustrative as there are numerous variations and modifications that may be made by those skilled in the art. Thus, the invention is to be construed as limited only by the spirit and scope of the appended claims.

I claim:

1. A combination golf score recording form and yardage map guide for a golf course, the guide comprising:

first, second and third sheets, each having first and second principal sides, foldably joined at one edge to each other in series such that said first and second sides are aligned on opposite sides of the joined sheets, said first and third sheets foldable over either side of said second sheet;

said second side of said third sheet having a first portion of a yardage map of the holes of a golf course printed thereon;

said first side of said third sheet having a second portion of said yardage map of the holes of the golf course printed thereon;

said first side of said first sheet having a first portion of a golf score recording form corresponding to said first portion of said yardage map printed thereon; and said first side of said second sheet having the second portion of said golf score recording form corresponding to said second portion of said yardage map printed thereon.

2. The guide as set forth in claim 1 wherein the golf course has 18-holes and the first portion of the holes of the golf course is 9-holes and the second portion of the holes is 9-holes, the guide further comprising:

said first portion and said second portion of said yardage map of the golf course displaying the individual layout of the holes with distances from various positions along the hole to the pin; and said golf score recording form displaying: par for each hole; handicap for each hole; length from tee to pin for each hole; and a place to record the score.

3. The guide as set forth in claim 2 wherein said three sheets are a single sheet of foldable stiff paper.

4. The guide as set forth in claim 1 wherein each of said sheets is the same size so that, when said first and third sheets are folded over either side of said second sheet, said guide has a size corresponding to the size of any one of said sheets.

5. The guide as set forth in claim 4 wherein the golf course has 18-holes and the first portion of the holes of the golf course is 9-holes and the second portion of the holes is 9-holes, the guide further comprising:

said first portion and said second portion of said yardage map of the golf course displaying the individual layout of the holes with distances from various positions along the hole to the pin; and said golf score recording form displaying: par for each hole; handicap for each hole; length from tee to pin for each hole; and a place to record the score.

6. The guide as set forth in claim 5 wherein said three sheets are a single sheet of foldable stiff paper.

* * * * *